US005809950A

United States Patent [19]

Letsche et al.

[11] Patent Number: 5,809,950

[45] Date of Patent: Sep. 22, 1998

[54] HYDRAULIC VALVE CONTROL ARRANGEMENT

[75] Inventors: Ulrich Letsche, Stuttgart; Ralf Gapp, Bad Wurzach, both of Germany

[73] Assignee: Daimler-Benz AG, Stuttgart, Germany

[21] Appl. No.: 866,513

[22] Filed: May 30, 1997

[30] Foreign Application Priority Data

May 31, 1996 [DE] Germany ..... 196 21 719.9

[51] Int. Cl.[6] ..... F01L 9/02

[52] U.S. Cl. ..... 123/90.12; 137/906; 251/25

[58] Field of Search ..... 123/90.12, 90.13, 123/90.14, 90.15; 91/356, 392, 461; 137/906; 251/25, 31

[56] References Cited

U.S. PATENT DOCUMENTS

| | | | |
|---|---|---|---|
| 5,193,495 | 3/1993 | Wood, III | 123/90.12 |
| 5,248,123 | 9/1993 | Richeson et al. | 123/90.12 |
| 5,595,148 | 1/1997 | Letsche et al. | 123/90.12 |

FOREIGN PATENT DOCUMENTS

| | | |
|---|---|---|
| 38 36 725 | 12/1989 | Germany . |
| 195 01 495 | 11/1995 | Germany . |
| 2 297 124 | 7/1996 | United Kingdom . |

*Primary Examiner*—Weilun Lo
*Attorney, Agent, or Firm*—Klaus J. Bach

[57] ABSTRACT

In a hydraulic valve control arrangement particularly of an internal combustion engine wherein the valve has a valve stem by which it is supported so as to be slideable between a closed and an open position and first there are provided first spring means biasing the valve in the closed position and second spring means providing an opening force which is transmitted via a valve tappet and an end of the valve tappet is received in a cylinder which is engaged by the second spring means so as to form a hydraulic force transmitting structure to which hydraulic fluid can be admitted for tensioning the second spring means. The valve tappet has a control piston received in a control chamber to which pressurized fluid is admitted which holds the control piston in either of its open or closed valve end positions and a pressure space is arranged adjacent the closed valve end positions of the control piston to which pressurized fluid can be admitted for initiating opening of the valve.

12 Claims, 4 Drawing Sheets

HYDRAULIC VALVE CONTROL ARRANGEMENT

BACKGROUND OF THE INVENTION

The invention relates to a freely activatable hydraulic valve control arrangement for a valve particularly of an internal combustion engine wherein the valve is movable between closed and open end positions by spring means which are hydraulically actuated to hold the valves in its end positions and to cause movement of the valve out of one end to the other end position.

DE 195 01 495 C1 already discloses a freely activatable hydraulic valve control arrangement which comprises a valve having a valve stem, and a helical compression spring acting on the latter in the valve-closing direction and an oil-pressure spring acting intermittently on the valve stem in the valve-opening direction. The valve control arrangement comprises a control piston which is arranged in a working space and is subjected to an operating fluid and which, in the region of its end positions, in each case partially delimits a pressure space which is part of the working space and which can be separated hydraulically from the latter. The pressure of the operating fluid in the working space can be regulated by a pressure source together with an electronically actuated switching valve in a fluid supply line. The tensioning force of the second spring means can be regulated during the operation of the valve control arrangement.

Reference is also made to DE 38 36 725 C1 for the general technical background.

It is the object of the present invention to provide an improved hydraulic valve control arrangement wherein the forces required to operate the valve are relatively low but the valve is always operated reliably.

SUMMARY OF THE INVENTION

In a hydraulic valve control arrangement particularly of an internal combustion engine wherein the valve has a valve stem by which it is supported so as to be slideable between a closed and an open position and first there are provided first spring means biasing the valve in the closed position and second spring means providing an opening force which is transmitted via a valve tappet and an end of the valve tappet is received in a cylinder which is engaged by the second spring means so as to form a hydraulic force transmitting structure to which hydraulic fluid can be admitted for tensioning the second spring means. The valve tappet has a control piston received in a control chamber to which pressurized fluid is admitted which holds the control piston in either of its open or closed valve end positions and a pressure space is arranged adjacent the closed valve end positions of the control piston to which pressurized fluid can be admitted for initiating opening of the valve.

One advantage of the arrangement according to the invention is that the valve-actuating forces can be matched particularly well to the valve-opening forces actually required and, at the same time, only the working fluid in the relatively small volume of the pressure space which can be separated hydraulically from the operating space has to be charged with the high pressure necessary for opening the valve against to the combustion-chamber pressure. In the engine-braking mode for example, particularly high valve-opening forces are required, since, in this case, the valve has to be pushed open near the end of the compression cycle against to the high gas pressure in the combustion-chamber. In view of the high combustion-chamber pressure and the effective valve-disc surface the valve opening forces required are by far greater in the engine-braking mode than in the driving mode or during idling of the internal combustion engine. The particularly high opening force is required only in a first part-stroke during valve opening, specifically until the plunger piston moves out of the associated pressure space and the valve is slightly opened. A lower valve-opening force is then sufficient for the further valve stroke, since, after the opening of the engine exhaust valve, a considerable expansion of the combustion gases out of the combustion chamber into the exhaust duct is taking place.

In comparison with electromagnetic valve control devices, the electrohydraulic device according to the invention also has, inter alia, advantages associated therewith in principle, since heavy, large-size electromagnets, requiring high currents, for exerting the corresponding control forces are not needed. In the valve control device according to the invention, electrical components are necessary only for the electrical activation of the switches for controlling the hydraulic fluid pressure for the individual pressure supply lines of the valve control arrangement.

In the valve-control arrangement device according to the invention, there is no consumption of hydraulic oil during the valve movement, but, instead, there is only a relatively small internal oil circulation flow, which is advantageous, particularly with regard to the valve control times and the energy consumption of the arrangement. The supply of energy to the arrangement takes place automatically, predominantly when the engine valve is in the closed position.

Preferably, any residual pressure, possibly still present in the hydraulic volume of the second spring means when the valve is completely open, is reduced, so that the valve-closing movement can be initiated reliably and complete closing of the valve is insured.

One advantage of varying the compression force of the second spring means, is that, on one hand, the energy loss occurring essentially due to friction during the actuation of the device can be compensated by compressing the second spring means and, on the other hand, reliable closing of the open valve is achieved. Any possibly excessive remaining compression force of the second spring means can be reduced, such that the valve spring can reliably close the valve.

Should the supply of hydraulic oil fail, the reliable closing of the lifting valve is insured in any position of the latter, in that, if the pressure in the control chamber drops, the pressure of the operating fluid in the hydraulic volume also drops and the closing of the lifting valve by the first spring means is thus guaranteed.

The valve is kept firmly in the open or closed position by releasing the pressurized fluid from the respective control spaces so that the control piston is held in position by the pressurized fluid in the control chamber. The fluid in the control chamber is always under pressure to hold the control piston in its end positions.

With a valve arranged in the control piston by which a passage leading from the hydraulic volume of the srcond spring means to the control chamber which can be opened when the pressure of the operating fluid in the in the hydraulic volume exceeds the pressure in the control chamber, a predetermined partial valve opening stroke can be obtained in a simple manner.

The invention will be explained in greater detail with reference to three exemplary embodiments shown in the accompanying drawings:

DESCRIPTION OF PREFERRED EMBODIMENTS

Figure 1:
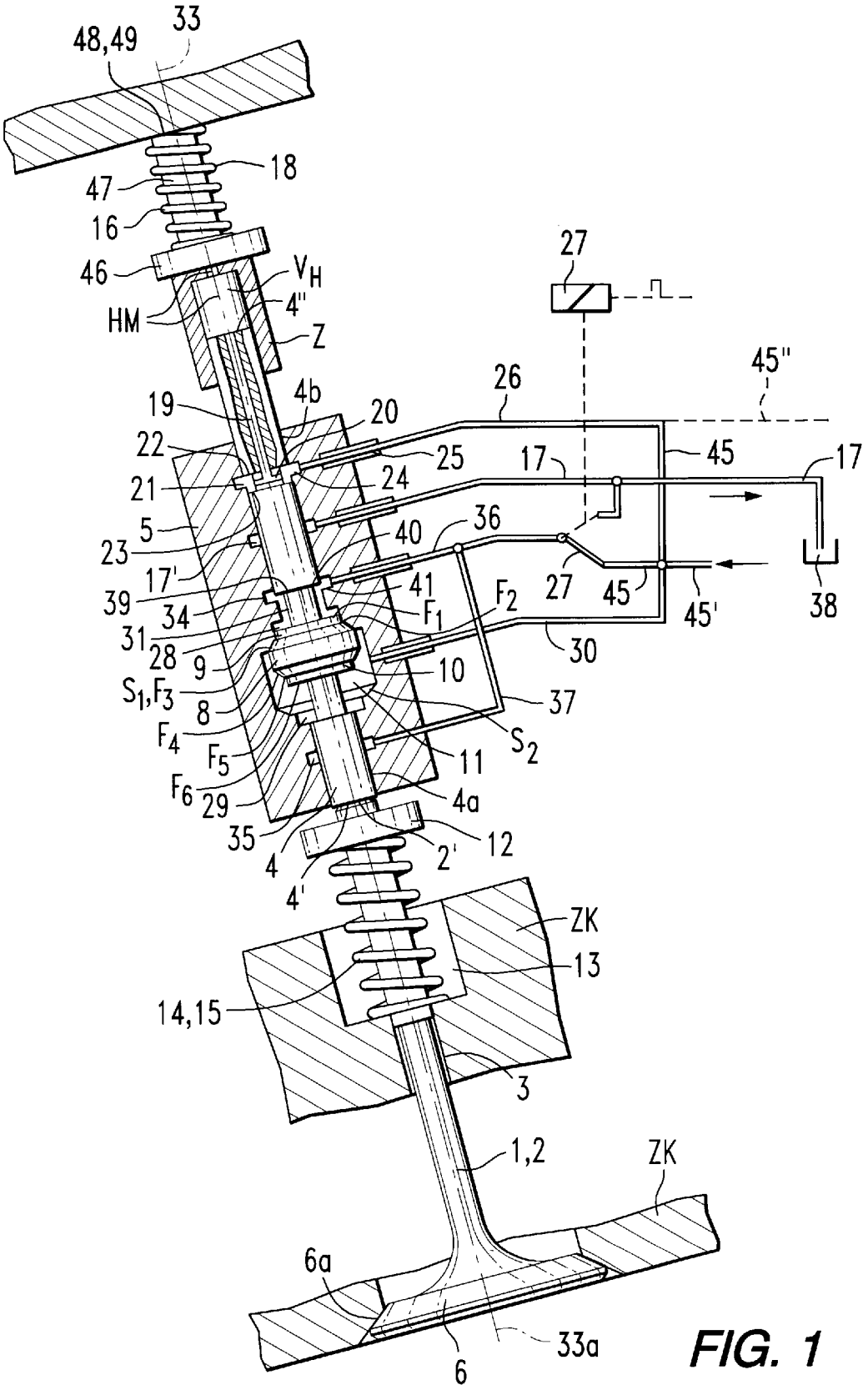
FIG. 1 shows, in a first exemplary embodiment, a freely activatable hydraulic valve control arrangement, with the valve closed, in a housing of an internal combustion engine (not shown), with a first spring means acting in the valve-closing direction and with a second spring means acting on a valve tappet in the valve-opening direction, the latter spring means being arranged between a hydraulic cylinder and the cylinder head in the extension of the valve axis, and the valve tappet forming a piston extending into the hydraulic cylinder.
Figure 2:
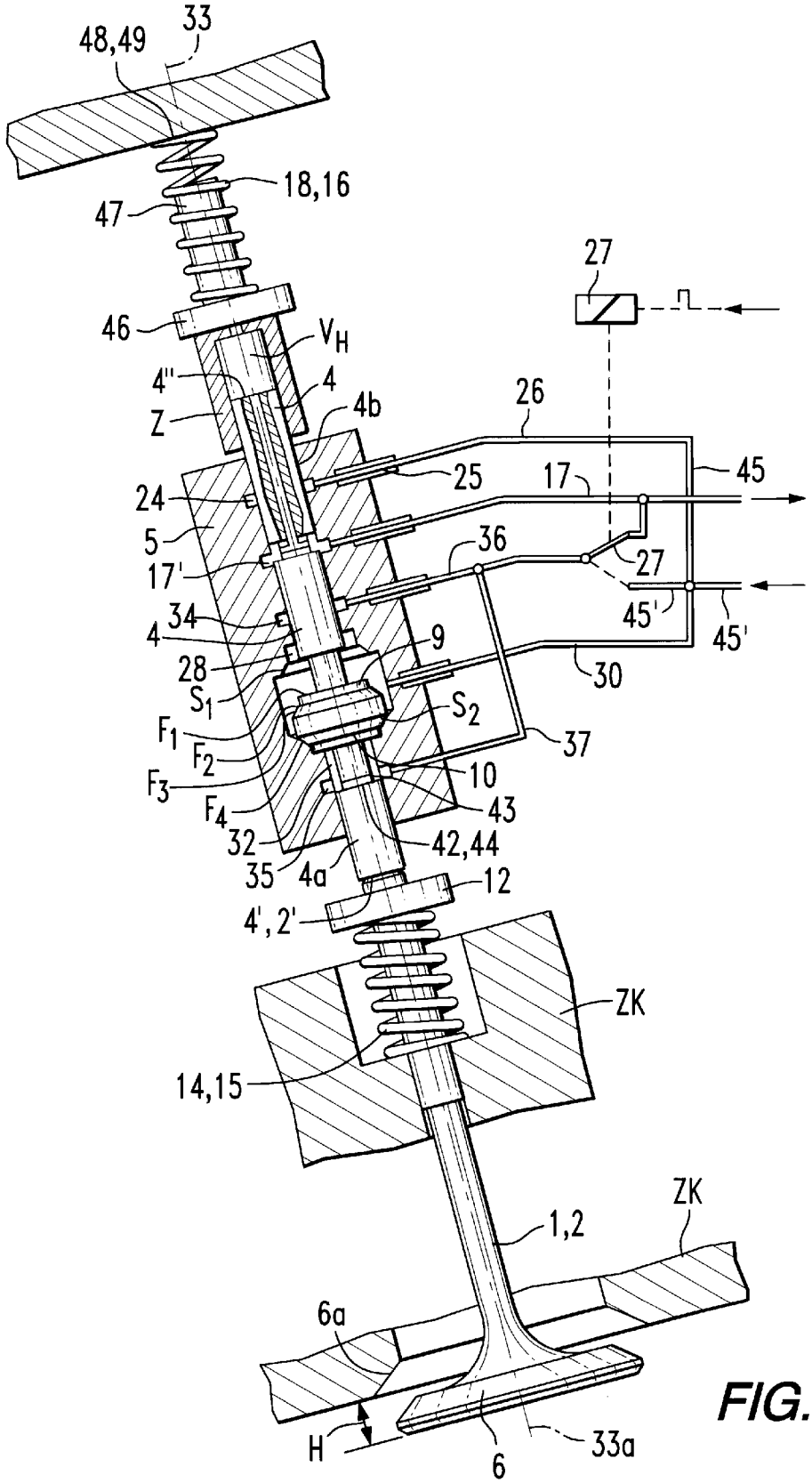
FIG. 2 shows a valve control arrangement like that of FIG. 1 when however the valve is completely open.

FIGS. 1 and 2 illustrate a freely activatable hydraulic valve control arrangement includes a valve 1, with a valve stem 2, which is guided in a valve guide 3 in a cylinder head ZK of an internal combustion engine (not shown). The valve 1 is illustrated in the closed position.

On the upper end face 2' of the valve stem 2, a valve tappet 4 bears with its lower end face 4' on the valve stem 2, the valve tappet 4 being guided in tappet guides 4*a* and 4*b* of a housing 5 in the internal combustion engine.

The valve 1 comprises, in addition to the valve stem 2, a valve disc 6 and a valve seat 6*a*. The valve tappet 4 comprises a control piston 8, described in greater detail below, which is preferably integrally formed with the valve tappet 4. The control piston 8 comprises two plunger pistons 9 and 10 integrally formed with the latter, the plunger piston 9 being arranged on the top side and the plunger piston 10 on the bottom side of the control piston 8.

Formed in the housing 5, between the two tappet guides 4*a* and 4*b*, is a cavity which forms a control chamber 11 for the control piston 8 with the plunger pistons 9 and 10, the valve tappet 4 passing through the control chamber 11. A first spring means 14 acting in the valve-closing direction is arranged between a spring receptacle 12 of the valve stem 2 and a spring receptacle 13 in the cylinder head ZK of the internal combustion engine. The spring means 14 is a helical compression spring 15 which is supported in the spring receptacles 12, 13 and is fixed thereto.

A non-positive connection between the valve 1 and valve tappet 4 is insured, in that the helical compression spring 15 presses the valve 1 firmly against the lower end face 4' of the valve tappet 4, irrespective of the operating state of the valve control arrangement.

Adjacent to the upper end face 4" of the valve tappet 4 is a hydraulic means HM for the transmission of forces between the second spring means 16 and the valve tappet 4, the hydraulic means HM comprising a hydraulic cylinder Z with a hydraulic volume $V_H$. The hydraulic volume $V_H$ is delimited essentially by the hydraulic cylinder Z and the end face 4" of the valve tappet 4 received in the hydraulic cylinder. The hydraulic volume $V_H$ is in communication with the hydraulic system of the valve control arrangement in a way described in greater detail below. The hydraulic cylinder Z is connected to a second spring means 16 which acts in the valve-opening direction and which comprises a helical spring 18 (compression spring). In this case, the helical spring 18 is arranged between spring receptacles 46 and 49 in the extension of a valve-tappet axis 33, the spring receptacle 46 being a spring plate which is connected to the hydraulic cylinder Z and to which a rod 47 is fastened. The rod 47 projects from the spring receptacle 46 in the direction of the other spring receptacle 49. The helical spring 18 is disposed around the rod 47. Arranged, at the same time, in the spring receptacle 49 is a stop 48, which the rod 47 engages when the compression spring 18 is compressed. The helical spring 18 (compression spring) is compressed, when the operating fluid in the hydraulic volume $V_H$ is under pressure and thus presses the hydraulic cylinder Z onto the spring plate 46 and compresses the helical spring 18 until the rod 47 fastened to the spring plate abuts the stop 48 (see FIG. 1).

The hydraulic volume $V_H$, which at the same time forms a lifting space for the valve tappet 4, is in communication with a control groove 21 of the valve tappet 4 by way of pressure passages 19 and 20 extending in the valve tappet 4. The control groove 21 has two control edges 22 and 23. The control groove 21 is intermittently connected hydraulically, in a way described in greater detail below, to a pressure duct 24 in the housing 5. The pressure passage is in the form of an annular groove, which extends around the valve tappet 4 and is in communication with a pressure supply line 45–45' via a duct 25 and a line 26.

The control chamber 11 receives the control piston 8 together with the plunger pistons 9 and 10, two pressure spaces 28 and 29 for the plunger pistons 9 and 10 being formed with the control chamber 11. The plunger piston 9 can enter the pressure space 28 in the region of the upper end position of the control piston 8 (see FIG. 1) and the plunger piston 10 can enter into the pressure space 29 in the region of the lower end position of the control piston 8 (see FIG. 2), with the result that each plunger piston 9 and 10 forms a partial delimitation of the pressure space 28 or 29 assigned to it.

Located in the control chamber 11 is an operating fluid (for example, hydraulic oil, lubricating oil or fuel) which is constantly pressurized via a pressure source (operating-fluid pump, not shown) by way of the supply line 30 together with the pressure supply line 45'. In the region of the upper end position of the control piston 8, the pressure space 28 can be pressurized via a communication passage 31 together with a pressure passage 34, the communication passage 31 being formed by an annular space around the valve tappet 4 between the latter and the housing 5 (see FIG. 1). In the region of the lower end position of the control piston 8, the pressure space 29 can be pressurized in a similar way via a communication passage 32 together with a pressure passage 35 (see FIG. 2).

The control piston 8 together with the plunger pistons 9 and 10 can be subjected to the operating fluid in the control chamber 11 on its opposite sides. When the plunger piston 9 or 10 plunges into the pressure space 28 or 29, the respective pressure spaces 28 or 29 are hydraulically separated from the control chamber 11.

By virtue of the radial distance between the control piston 8 and the inner wall of the control chamber 11, the control piston 8 is designed in such a way that, after one of the two plunger pistons 9, 10 has moved out of the associated pressure space 28 or 29, the control chamber 11 and the two pressure spaces 28 and 29 are connected hydraulically to one another, the hydraulic connection of the two pressure spaces 28, 29 being formed by the control chamber 11 itself.

The force compressing the second spring means 16 (helical spring 18) can be controlled, during the operation of the hydraulic valve control device, by the hydraulic means HM in a way described in greater detail below. With the operating fluid in the pressure spaces 28 and 29 being relieved of pressure and with the second spring 16 being compressed, the first spring means 14 (helical compression spring 15) keeps the valve 1 in a closed position, since the pressure in the control chamber 11 on the effective surface of the control piston 8, together with the spring force of the first spring means 14, overcomes the force of the second spring means 16.

The energy loss occurring during a valve movement cycle can be compensated via a cyclic variation of the compression force of the second spring means 16. With the lifting valve 1 closed, the pressure in the hydraulic volume $V_H$ can be built up from the pressure supply line 45–45' via the pressure ducts 19, 20 and the control groove 21 by way of the pressure passage 24 and the line 26.

With the valve 1 closed, and if it is intended to be opened, a build-up of the oil pressure in the pressure spaces 28, 34 can be controlled via the connecting conduit 36 by means of an electrical switching valve 27, while the control chamber 11 is pressurized at all times via pressure supply lines 45, 30. The connection of the connecting line 36 to a pressure-relief line 17, leading to a reservoir 38, or to a pressure supply line 45, 45' connected to a operating-medium pump can be selectively made or broken via the electrical switching valve 27 (for example, electromagnetic valve).

Hydraulically effective surfaces F1–F6 of the control piston 8 of the valve tappet 4 are oriented perpendicularly or obliquely to the valve-tappet axis 33. The valve-tappet axis 33 preferably coincides with an extension of the axis 33*a* of the valve (see FIG. 1), in order to avoid unnecessary transverse forces in the valve guide 3 or in the tappet guides 4*a* and 4*b*.

Applying pressure to the pressure spaces 28, 29 assigned to the end positions of the control piston 8 generates a force component parallel to the valve-tappet axis 33, the force component corresponding to the projecting surface fraction of the respective surface F1–F6. The hydraulically effective surfaces F1–F6 of the control piston 8 are of equal size in the valve-opening direction and in the valve-closing direction when the plunger pistons 9 and 10 are not in the respective pressure spaces 28 and 29. The surfaces F1/F6, F2/F5 and F3/F4 are of equal size and are arranged symmetrically with respect to a plane perpendicular to the valve axis 33*a*.

When the plunger piston 10 is disposed in the pressure space 29, the open valve 1 (see FIG. 2) can be kept in its open position, against the pressure of the first spring means 14 (helical compression spring 15) and against a force on the valve disc 6 which may act in the valve-closing direction, by relieving the operating fluid pressure in the pressure space 29 and by maintaining the operating fluid in the control chamber 11 under pressure.

The pressure passages 34 and 35 are located above and below the control chamber 11 and can be connected selectively (via the electromagnetic switching valve 27) to a reservoir 38 (pressure-relief line 17) or to the pressure supply line 45' via a connecting conduit 36 or 37 respectively. The hydraulic connection between the communication passage 31 and pressure passage 34 is controlled by means of a control groove 39 formed in the valve tappet 4, together with the control edge 40 (see FIG. 1). The hydraulic connection between the communication passage 32 and the pressure duct 35 is made in a similar way to this by means of a control groove 42 arranged in the valve tappet 2, together with the control edge 44 (see FIG. 2). The communication passages 31, 32 open into the respective control grooves 39 (see FIG. 1) and 42 (see FIG. 2) at points 41, 43.

In the upper end position of the control piston 8, the conical surface F3 is pressed against a seat S1 of the working space 11, with the result that the pressure space 28 is separated hydraulically from the control chamber 11 (see FIG. 2). Similarly, in the lower end position of the control piston 8, the conical surface F4 is pressed against a seat S2 of the working space 11, with the result that the pressure space 29 is separated hydraulically from the working space 11 (see FIG. 2).

The operation of the hydraulic valve control arrangement according to the invention is described below and is explained with reference to a valve movement cycle, starting from the closed position of the valve, as illustrated in FIG. 1.

First of all, the arrangement is put into operational readiness by conveying the operating fluid out of the reservoir 38 by means of an operating fluid pump (not shown) and by building up a supply pressure in the pressure supply lines 45, 45' and 30. The switching valve 27 is in the position represented by dashed lines in FIG. 1, so that the connecting line 36 is connected to the pressure-relief line 17. Irrespective of the switching state of the electrical switching valve 27, the lines 26 (to the pressure duct 24) and the supply line 30 (to the working space 11) are pressurized by operative fluid via the pressure supply line 45'.

The pressure of the operating fluid in the hydraulic volume $V_H$ is built up via the line 26, the duct 25, the control groove 21 and the pressure passages 20 and 19, with the result that the helical spring 18 is compressed. The hydraulic cylinder Z together with the hydraulic volume $V_H$ serves for hydraulic force transmission between the valve tappet 4 and the helical compression spring 18, so that, as far as the second spring means 16 is concerned, only the force of the helical compression spring 18 acts on the spring/mass system.

When the control chamber 11 is pressurized, the pressure spaces 28, 34 are relieved of pressure via the connecting conduit 36 as a result of the position of the electrical switching valve 27 (connection of the pressure-relief line 17 and connecting conduit 36), this position being illustrated by dashed lines in FIG. 1, with the result that the spring/mass system remains in its upper end position (see FIG. 1), since the top side of the control piston 8 (plunger piston 9) is relieved of pressure as the pressure space 28 is in communication with the reservoir 38 of operating fluid via the communication passage 31, the annular pressure-passage 34 and the connecting conduit 36. By contrast, the pressure in the control chamber 11 is effective on the corresponding effective hydraulic surface of the control piston 8 (annular surfaces F5 and F6 perpendicular to the lifting-valve axis 33 and the annular surface F4 oblique thereto) and generates a resultant counter-force which presses the control piston 8 upwards. The valve 1 thus remains closed.

To retain the valve 1 in an upper or lower end position, the pressure spaces 28, 34 and 29, 35 respectively are relieved of pressure. To initiate the movement of the valve, the electro-magnetic valve 27 is actuated (illustrated by unbroken lines in FIG. 1), so that the plunger piston 9 or 10 which is disposed in the plunger cylinder 28 or 29 respectively is pressurized. An approximate pressure equilibrium thus prevails on the control piston 8, so that the locking force is at least partially canceled. Since the respective spring, which, in the respective end position, is compressed to a greater extent, switching of the charge cycle valve now causes the control piston 8, together with the valve tappet 4 and valve 1 to commence its oscillation from the upper end position into the lower end position, or vice versa. After the respective plunger piston 9 or 10 has left the plunger cylinder 28 or 29 assigned to it, the electromagnetic valve 27 can be reset (illustrated by dashed lines in FIG. 1).

During the movement of the valve 1 in the valve-opening direction, after only a very small valve stroke (at the latest when the plunger piston 9 emerges from the pressure space 28) the control edge 40 interrupts the hydraulic connection between the control chamber 11 and the connecting conduit 36, so that no operating fluid can be returned, if the switching valve 27 is switched into the position represented by dashed lines in FIG. 1.

When the plunger piston 9 has emerged completely from the pressure space 28 not far from of the upper end position of the control piston 8, the pressure space 28 and pressure space 29 are connected hydraulically to one another via the control chamber 11. From this moment on, the pressure in the control chamber 11 no longer has any influence on the behavior of the control piston 8 because of the above-mentioned symmetry of the critical surfaces F1–F6 of the latter.

The switching valve 27 is then switched over again (illustrated by dashed lines in FIG. 1), so that the pressure in the open end passage 28, 34 is relieved. This operation has no influence on the movement of the control piston 8. However, it is necessary to insure that, when the plunger piston 10 plunges into the pressure space 29, the pressure space 29 is relieved of pressure via the pressure relief line 17, the connecting conduit 37 and the switching valve 27. The pressure in the control chamber 11 then retains the spring/mass system in its lower end position.

Shortly before the lower end position of the control piston 8 is reached, the valve tappet 4 opens with its control edge 44 the hydraulic connection between the connecting duct 32 and pressure passage 35. The plunger piston 10 interrupts the connection between the control chamber 11 and pressure space 29, the different pressures on the effective hydraulic surfaces of the control piston 8 (plunger piston 9/10) providing for a resultant force on the control piston 8 in the valve-opening direction. This force moves the spring/mass system into its lower end position and retains it there, with the result that the valve 1 (see FIG. 2) remains open.

The energy loss which occurs during the movement cycle is compensated via a cyclic variation of the compression force of the helical compression spring 18. This takes place, in the lower end position of the spring/mass system, by the reduction of a still existing residual pressure in the hydraulic volume $V_H$ via the pressure passages 19 and 20, and the control groove 21, into the annular pressure-relief passage 17' and the pressure-relief line 17 (see FIG. 2). In the lower end position of the spring/mass system, the control edge 23 of the control groove 21 is located in the region of the annular pressure-relief passage 17'.

Since the helical compression spring 15, is then compressed to a greater extent than the second spring means 16 (helical spring 18), the return movement of the valve 1 to its upper end position is insured. However, because of the preceding reduction of residual pressure in the hydraulic volume $V_H$, the helical spring 18 is not compressed to the original state. The spring tensioning force is therefore restituted in the upper end position of the spring/mass system (see FIG. 1), by applying pressure to the operating fluid in the hydraulic volume $V_H$ in the hydraulic cylinder Z via the line 26 and the duct 25, the control groove 21 and the pressure passages 19, 20, 24. This insures that, at the commencement of the next operating cycle, the helical compression spring 18 is pretensioned to a greater extent than the helical compression spring 15. In this case, in the two end positions of the spring/mass system, the energy supplied to the system can be varied independently of one another by varying the pressures between which the helical compression spring is operated. These pressure variations can be implemented by pressure-regulating devices (not shown) for the pressures prevailing in the pressure supply line 45 and in the reservoir 38.

Particularly in an engine-braking mode, during closing of the valve first only the helical compression spring 18 is compressed. The pressure of the operating fluid in the hydraulic volume $V_H$ can be further increased when the rod 47 abuts the stop 48, for example by additionally pressuring the line 26 via a further supply line 45" which may be provided in addition to the supply line 45'. A non-return valve (not shown) should then be arranged in the line 45 or 45'. With such an arrangement, the hydraulic volume $V_H$ functions as a hydraulic spring, so that this, together with the helical spring 18, constitutes a series-type spring arrangement.

For the valve-opening movement, an excess force is available in the valve-opening direction, since the spring force of the second spring means 16 is at that point substantially greater than that of the first spring means 14 (helical compression spring 15) in the center-position M (=half the valve stroke). In the fully open position of the valve 1, the valve 1 is kept open as a result of the above-described relief of pressure via the annular passage 35.

In contrast, during the valve-closing movement, an excess force prevails in the valve-closing direction, since in the mid-position M the spring force of the first spring means 14 is greater than that of the second spring means 16. It is thus possible, in each case, to insure that the valve reaches its end position.

Figure 3:
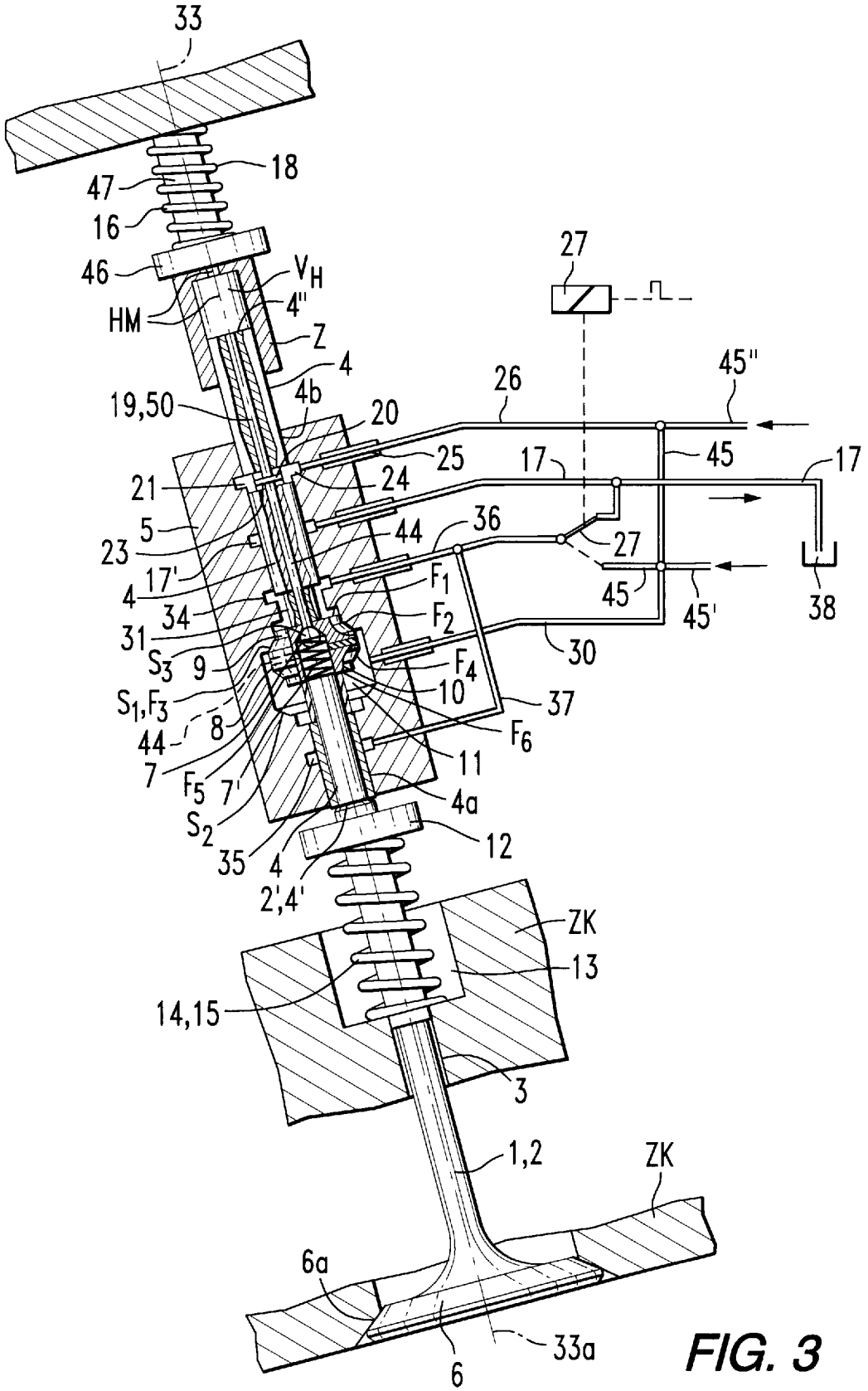
FIG. 3 shows, in a second exemplary embodiment, a valve control arrangement similar to that of FIG. 1, wherein a control piston included in the valve tappet includes a non-return valve, by means of which a hydraulic passage between a hydraulic means and a control chamber can be opened or closed.

FIG. 3 shows a second exemplary embodiment of a valve control arrangement similar to that of FIG. 1, there being arranged inside a control piston 8 of the valve tappet 4 a valve 7, by means of which a hydraulic passage 50 between the hydraulic volume $V_H$ and the control chamber 11 can be opened or closed. Similar components of FIGS. 1 and 2 are designated by the same reference numerals.

The valve 7 is designed as a spring-loaded non-return valve which comprises a spring 7', a closing ball and a valve-seat surface S3. The non-return valve 7 is arranged in such a way that the closing ball is lifted off the valve-seat surface S3 against the force of the spring 7' when the pressure in the hydraulic volume $V_H$ exceeds the pressure in the working space 11. When the pressure in the control chamber 11 is higher than, or equal to, the pressure in the hydraulic volume $V_H$, the hydraulic connection between the control chamber 11 and hydraulic volume $V_H$ is interrupted.

When the valve control device according to the invention is operating normally, the situation in which the pressure in the hydraulic volume $V_H$ is higher than the pressure in the control chamber 11 does not arise. If the supply of hydraulic fluid fails, however, the non-return valve 7 according to the invention insures that, irrespective of the position of the valve 1, the latter can be moved into its closed position (shown), in that the excess pressure in the hydraulic volume $V_H$ can released into the control chamber 11 via the hydraulic passage 50, The spring 14 consequently closes the engine valve 1 and the valve tappet 4 moves into the cylinder Z.

In the embodiment of the invention according to FIG. 3, therefore, the operating fluid in the hydraulic volume $V_H$ cannot be pressurized to a greater extent than the operating fluid in the control chamber 11.

Figure 4:
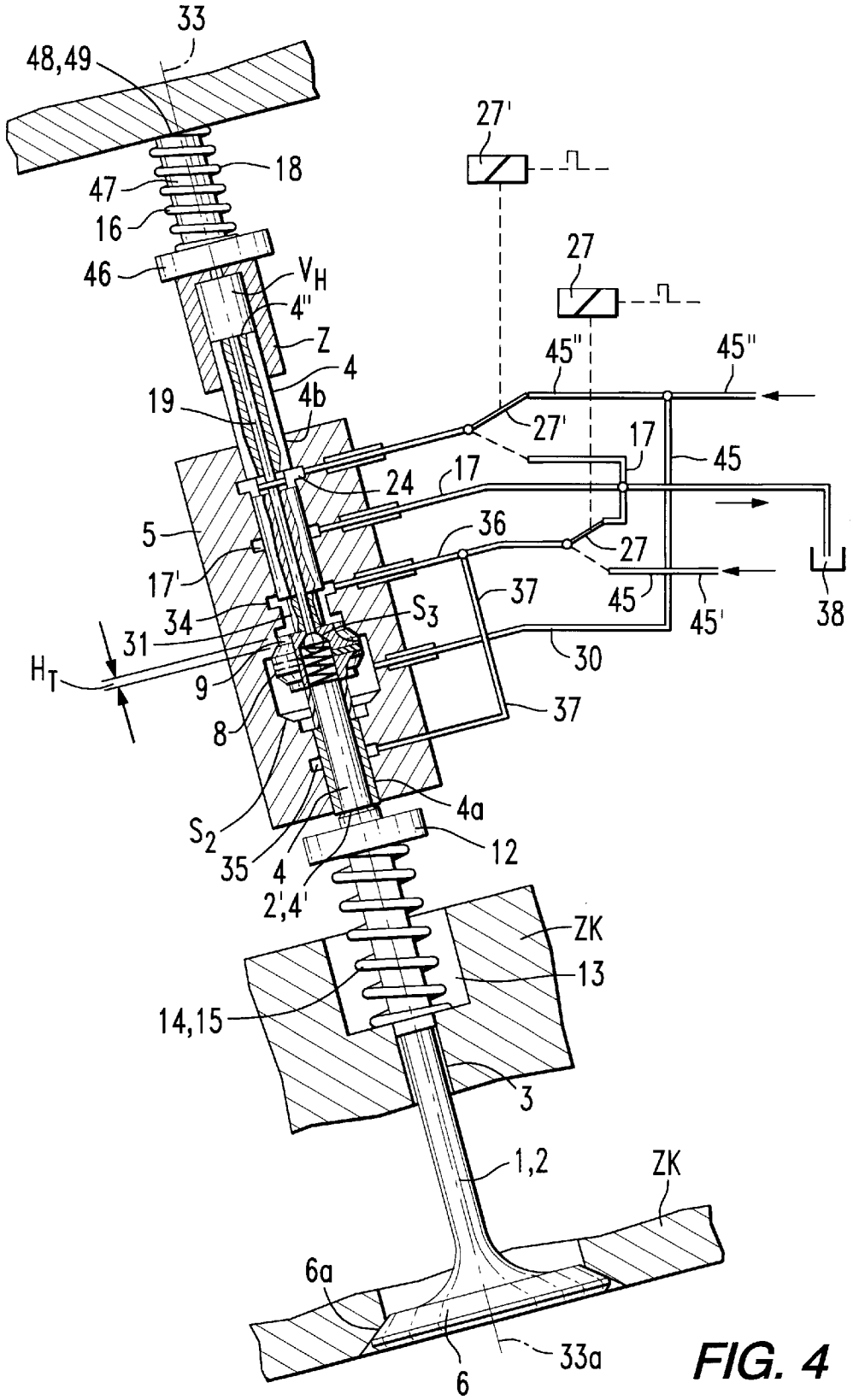
FIG. 4 shows, in a third exemplary embodiment, a valve control arrangement similar to that of FIG. 3, with a separate pressure control for a pressure space implementing a predeterminable partial-stroke operation for the engine valve.

FIG. 4 shows a third exemplary embodiment of a valve control arrangement similar to that of FIG. 3, but with a separate pressure control for a pressure space for the purpose of implementing a predeterminable partial opening stroke for the valve 1. Similar components of FIGS. 1 to 3 are designated by the same reference symbols.

The line 26 to the pressure passage 24 can be connected selectively to the pressure supply line 45" or to the pressure-relief line 17 (return) via a further switching valve 27' (for example, electromagnetic valve). In the shown position of the switching valve 27', the arrangement of FIG. 4 operates like the exemplary embodiment illustrated in FIG. 3.

However, if the switching valve 27' is switched into the position illustrated by dashed lines in FIG. 4, the helical spring 18 of the second spring means 16 can relax, at the same time generating a flow of operating fluid through the switching valve 27' through the return line to the reservoir 38. If movement of the valve 1 is then initiated, the latter moves by a particular partial-stroke $H_T$, until the upper plunger piston 9 emerges from the associated pressure space 28 and the valve 1 remains in this position. If, in order to trigger the valve movement, the switching valve 27' is reset again into the position shown by unbroken lines in FIG. 4, the lifting valve 1 is moved back into its closed position shown by the force of the closing spring 15 (first spring means 14).

The proposed version according to FIG. 4 therefore makes it possible to open the engine valve 1 only to a part-stroke $H_T$ defined by the plunging distance of the plunger piston 9 into the pressure space 28, to retain it at the part-stroke opening position and to close it again at a freely selectable moment.

With this valve control arrangement normal valve strokes can be implemented within, for example, 5–10 milliseconds with an energy consumption of about 100–250 watts (with 50 openings per second).

In the exemplary embodiments shown, the valve stem 2 and the valve tappet 4 together with the control piston 8, are two parts, but the valve stem and valve tappet, and the control piston may of course also be designed as an integral part.

In a further embodiment of the invention, the intermittent separation of the pressure spaces 28, 29 from the control chamber 11 can be carried out by means of conical or flat sealing seats which are formed between the pressure spaces 28 and 29 and the control piston 8. In this case, for example, the surfaces S1/F3 and S2/F4 could also be flat sealing seats instead of conical seats (as illustrated in the exemplary embodiment). In both instances, that is in an embodiment with a conical seat and in the embodiment with flat sealing seats, the intermittent separation of the pressure spaces 28, 29 can be carried out solely by means of these conical or flat sealing seats, whereby the plunger piston according to the above exemplary embodiment is not needed.

The above-described freely activatable valve control arrangement can be used for controlling any type of valve, in particular intake and exhaust valves of internal combustion engines and piston compressors.

What is claimed is:

1. A hydraulic operating mechanism for a valve of an internal combustion engine, said valve having a valve stem slideably supported such that said valve is axially movable between a closed and an open position, first spring means engaging said valve so as to bias it in a valve closing direction, second spring means for providing a valve opening force to said valve, and valve control and actuating means including a valve tappet arranged in axial alignment with said valve stem so as to be movable therewith and having a control piston disposed in a control chamber and movable with said valve tappet between opposite end positions in which said control piston closes opposite flow passages of said control chamber so as to define separate pressure spaces adjacent said control piston at opposite ends of said control chamber, means for admitting pressurized fluid to said control chamber for holding said control piston in either of its opposite end positions to either hold the valve in an open valve position or a closed valve position, means for tensioning said second spring means to a certain degree depending on engine operating conditions, and means for controlling the pressure in at least one pressure space at one side of said control piston where said control piston closes said one pressure space in one of its end positions so as to trigger movement of said control piston and the valve associated therewith out of said one end position.

2. A hydraulic valve operating mechanism according to claim 1, wherein means are provided for releasing pressure from either of said pressure spaces closed off by said control piston in one end position thereof for holding said control piston and the associated valve in the respective end position.

3. A hydraulic valve operating mechanism according to claim 1, wherein said control chamber is connected to a pressurized fluid supply line so as to be always under pressure during operation of the valve operating mechanism.

4. A hydraulic valve operating mechanism according to claim 3, wherein the pressure space adjacent said control chamber remote from said valve is in communication, by a flow passage, with a first pressure control passage controllable by said valve tappet so as to be open when said valve is in a closed position and a flow control valve is arranged in a fluid communication line to said pressure control passage for supplying pressurized fluid to said pressure space or to relieve the pressure therein, and a second pressure control passage extends around said valve tappet adapted to provide for communication between said pressurized fluid supply line and a hydraulic volume associated with said second spring means for tensioning said second spring means when said valve tappet and said valve are in a closed valve end position.

5. A hydraulic valve operating mechanism according to claim 4, wherein different pressures can be applied to said first and second pressure control passages and, for moving said valve out of its closed position, said first pressure control passage is subjected to a greater pressure than said second pressure control passage.

6. A hydraulic valve operating mechanism according to claim 4, wherein said second spring means includes a coil spring and hydraulic means disposed between said coil spring and said tappet for tensioning said coil spring.

7. A hydraulic operating mechanism for a valve according to claim 6, wherein said hydraulic means includes a cylinder receiving an end of said tappet to form therewith a control volume and said tappet includes a pressure passage extending from said second pressure control passage to said control volume for supplying hydraulic fluid under pressure thereto to compensate for energy losses occurring during a valve movement cycle by tensioning said coil spring when said valve is in a closed position.

8. A hydraulic valve operating mechanism according to claim 4, wherein a hydraulic passage extends through said tappet from said hydraulic volume to said control chamber and a valve is disposed in said hydraulic passage within said control piston.

9. A hydraulic valve operating mechanism according to claim 8, wherein said valve is a one-way valve which permits fluid flow only from said hydraulic volume to said control chamber.

10. A hydraulic operating mechanism for a valve according to claim 4, wherein said second pressure space is connected to a second pressurized fluid supply line providing a different fluid pressure than is provided to said first pressure space and said second pressurized fluid line includes a switch-over valve for connecting said second pressure space selectively to said second pressurized fluid line for tensioning said second spring means or to a fluid release line for releasing tension from said second spring means.

11. A hydraulic operating mechanism for a valve according to claim 10, wherein after the valve opening movement has been initiated, pressure release in said second pressure space holds said valve in a partially open position.

12. A hydraulic valve operating mechanism according to claim 11, wherein said control piston has at its end opposite said valve a plunger piston having an axial length corresponding to a desired partial opening stroke of said valve.

* * * * *